US006009921A

United States Patent [19]

Stone, Jr.

[11] Patent Number: 6,009,921

[45] Date of Patent: Jan. 4, 2000

[54] HIGHLIFT ANTIWEAR ATTACHMENT FOR ANGLE DEBARKING DRUM LIFTERS

[75] Inventor: Robert Stone, Jr., Crosby, Miss.

[73] Assignee: The Price Companies, Inc., Monticello, Ark.

[21] Appl. No.: 09/286,681

[22] Filed: Apr. 5, 1999

[51] Int. Cl.[7] ..... B27M 1/00; B27L 1/02; B02C 17/22

[52] U.S. Cl. ..... 144/326; 144/208.1; 144/208.9; 144/341; 241/183; 241/300; 241/DIG. 30

[58] Field of Search ..... 144/208.1, 208.4, 144/208.9, 341, 329; 241/300, 299, 183, 182, DIG. 30

[56] References Cited

U.S. PATENT DOCUMENTS

| | | | |
|---|---|---|---|
| 1,289,447 | 12/1918 | Guettler . | |
| 1,311,226 | 7/1919 | Guettler . | |
| 2,665,721 | 1/1954 | Busch . | |
| 3,269,438 | 8/1966 | Guettler . | |
| 3,286,747 | 11/1966 | Delcellier . | |
| 3,417,796 | 12/1968 | Leider et al. . | |
| 3,746,063 | 7/1973 | Smiltneek . | |
| 3,807,469 | 4/1974 | Schnyder . | |
| 3,896,863 | 7/1975 | Smiltneek . | |
| 3,955,608 | 5/1976 | Smiltneek . | |
| 4,369,823 | 1/1983 | Gustafsson . | |
| 4,784,197 | 11/1988 | Alander et al. . | |
| 5,005,621 | 4/1991 | Woodham . | |
| 5,019,123 | 5/1991 | Clarke-Pounder et al. . | |
| 5,197,524 | 3/1993 | Clarke-Pounder et al. . | |
| 5,381,976 | 1/1995 | Chon et al. | 241/300 |
| 5,464,164 | 11/1995 | Duppstadt | 241/300 |
| 5,752,665 | 5/1998 | Wason | 241/300 |
| 5,839,490 | 11/1998 | Kiedaisch et al. . | |

*Primary Examiner*—W. Donald Bray
*Attorney, Agent, or Firm*—Ray F. Cox, Jr.

[57] ABSTRACT

An improved lifter and a method of repairing a damaged lifter employed in a rotary drum debarker of the type which removes the bark of logs by introducing logs into a rotating drum wherein the the logs tumble and flail against one another so that the bark is removed by the tumbling and rubbing action of one log against another. A plurality of lifters are arranged around the interior surface of the drum so that the point or vertex of the lifter is facing toward the axis of rotation of the drum. The lifters are provided with cleats on the vertex of the lifter in the direction of rotation of the drum to protect the lifter from excessive wear. In addition the cleat lifts the logs higher in the drum which improves the tumbling action. Damaged lifters may be repaired by the addition of the cleat to the vertex of the lifter.

6 Claims, 3 Drawing Sheets

30
37
39
35
31
38
36
32
33
34
35

HIGHLIFT ANTIWEAR ATTACHMENT FOR ANGLE DEBARKING DRUM LIFTERS

The present invention relates to rotary drum debarkers for removing bark from logs, and in particular, to improvements in lifters employed in rotary drum debarkers to assist in the lifting and tumbling action required for the debarking action of the rotating drums. The particular improvements relate to the addition of a cleat to the vertex of a lifter in order to protect the lifter from wear and to improve the lifting action.

BACKGROUND OF THE INVENTION

Rotary drum debarkers are widely employed to remove the bark from logs. The rotary drum debarker is essentially a long cylindrical shell into which the logs are introduced. The drum rotates which causes the logs to tumble and to rub against one another. The tumbling and rubbing action serves to separate the bark from the log so as to prepare the log for further processing, for example as pulpwood in the manufacture of paper.

The shell of the debarking drum is typically thin with slots for the bark to fall through. The interior of the shell is lined with generally longitudinally oriented lifters. The lifters may take the form of L or V shaped angle irons or channels which are welded to the interior of the shell. It should be understood that the lifters may take many shapes and be oriented in various ways in the interior of the drum. The lifters are typically oriented so that the peak or vertex of the lifter is pointed generally toward the axis of rotation of the drum and the legs of the lifter are welded to the inside surface of the shell of the drum. The lifters serve to increase the strength and rigidity of the drum and also serve to lift the logs in the drum as the drum rotates thereby enhancing the tumbling action and therefore the efficiency of bark removal from the logs introduced into the rotary drum debarker. Reinforcing rings may be added to the shell at the inlet and outlet. The reinforcing rings may be welded to the ends of the lifters to reinforce both the lifters and the shell itself.

The tumbling action of the logs produces considerable stress on the structure of the drum and particularly the lifters. Although the lifters are substantial and designed for the severe environment in which they operate, it is inevitable that the lifters will wear and sustain other damage from the tumbling logs. The vertex of the lifters are most exposed to the action of the tumbling logs and therefore suffer the earliest and worst wear. In time the vertex of a lifter may even wear completely through. When this event occurs, or even before this event, it is necessary to replace the lifter to avoid substantial weakening of the structural integrity of the relatively thin walled shell of the drum and to maintain the efficiency of the lifting action.

Repair of a damaged lifter normally requires replacement of the lifter, which in turn entails cutting all or part of the damaged lifter from the drum and welding a new lifter in place of the damaged lifter. This process is difficult, time consuming, and most importantly, requires that the entire rotary drum debarker be taken out of service while the replacement is being effected. In some facilities, taking a debarker is out of service means that the entire facility is either out of service or its operation is substantially curtailed. There is therefore a strong incentive to avoid the necessity of replacing worn or damaged lifters.

Various configurations of lifters are known in the art. For example, U.S. Pat. No. 3,286,747 to Delcellier discloses a debarking drum with various inner surface corrugations including sawtoothed (either sharp edged or rounded) and dimpled variations.

U.S. Pat. No. 5,839,490 to Kiedaisch et al. discloses a debarking drum with a rubber lining for a corrugated inner surface. Kiedaisch et al. note that metal lifters on debarking drums are often lined with rubber to extend the life of the lifters. Kiedaisch et al. also disclose reinforcement members 50, 150 which extend from the leading edge to the trailing edge of each rubber liner and which are stated to extend the life of the liner.

U.S. Pat. No. 1,289,447 to Guettler discloses a drum debarker whose walls are formed of a number of angle bars. The angles project into the interior of the drum and form lifters.

U.S. Pat. No. 3,746,063 to Smiltneek discloses a method for debarking logs wherein a number of high density objects, such as steel slugs, are allowed to randomly impact the logs to assist in loosening the bark. Smiltneek otherwise discloses a fairly conventional debarker drum where the lifters are longitudinal vanes of a triangular shape and with a sharp edged vertex.

U.S. Pat. No. 5,197,524 to Clarke-Pounder et al. relates to a method of introducing steam through longitudinal lifters (staves 50). The staves are shown in cross section as a triangular shape with a rounded vertex.

U.S. Pat. No. 5,019,123 to Clarke-Pounder et al. primarily relates to a discharge control system. Longitudinal lifters (staves 17) with a conventional triangular cross section are disclosed.

U.S. Pat. No. 3,955,608 to Smiltneek discloses a debarker drum with longitudinal vanes 38 which are square or rectangular in cross section.

U.S. Pat. No. 3,807,469 to Schynder discloses a debarking drum with pusher elements 52 which are triangular in cross section. The triangular cross sections are not symmetrical in that the vertex is displaced away from the direction of rotation of the drum.

U.S. Pat. No. 1,311,226 to Guettler disclose lifters which are rounded corrugations. The purpose of the rounded shape is to avoid brooming caused by sharp edged lifters.

U.S. Pat. No. 4,784,197 to Alander et al. discloses a method of heating a debarking drum. The drum is shown with distribution pipes 12 which appear to serve as lifters as well as means for introducing steam. The cross sectional shape appears to be triangular with a rounded vertex.

U.S. Pat. No. 4,369,823 to Gustafsson discloses a drum with a series of sections each having varying numbers of log lifters. The lifters appear to be half cylindrical in cross section.

U.S. Pat. No. 3,896,863 to Smiltneek discloses a debarking apparatus with a number of offset debarking chambers. Longitudinal triangular lifters are shown.

U.S. Pat. No. 3,417,796 to Leider et al. discloses a debarker that may include longitudinal lifters which appear to be somewhat triangular or rectangular in cross section with a rounded vertex.

U.S. Pat. No. 3,269,438 to Guettler discuses the problem of weld failure in "barking irons." "Barking irons" are described as longitudinal members with cross sections that may be M-shaped, U-shaped, etc. The solution offered by Guettler is to replace the "barking irons" with corrugated plates having fewer exposed welds.

U.S. Pat. No. 2,665,721 to Busch discloses a debarking drum with fluted metal slats which may serve as lifters.

The limitations of the prior art are overcome by the present invention as described below.

SUMMARY OF THE INVENTION

The present invention relates to rotary drum debarkers. These devices are employed for the purpose of removing the bark from logs. The rotary drum debarker accomplishes this purpose by introducing a plurality of logs into a large rotating drum. The rotating drum causes the logs to tumble and flail against one another so that the bark is removed by the tumbling and rubbing action of one log against another.

In order to assist the tumbling action, the rotary drum debarker has a plurality of lifters arranged around the interior surface of the drum. A description of the typical lifters found in a rotary drum debarker is disclosed in Woodham (U.S. Pat. No. 5,005,621), the disclosure of which is incorporated herein by reference.

One of the more commonly used types of lifters takes the form of a V-shaped angle iron welded to the interior surface of the drum so that the point or vertex of the angle is facing toward the axis of rotation of the drum. This vertex of the lifter is subjected to considerable wear and tear from the tumbling action of the logs. After a period of time the lifters tend to be worn away and it is necessary to cut them out and replace them or to weld repair pieces to the damaged lifter.

To avoid this problem, the present invention modifies the lifter by welding a metal bar or cleat onto the vertex of the lifter on the side of the lifter toward the direction of rotation of the drum. This has the advantage of protecting the lifter from excessive wear and furthermore the cleat lifts the logs higher in the drum which improves the tumbling action. The enhanced tumbling action from the improved log lifting that occurs with the addition of the cleat increases the throughput capability of the debarking drum. Alternatively, the rotation of the debarking drum can be slowed and still produce the same throughput with reduced wear and tear on the debarking drum and therefore reduced maintenance cost.

A new lifter may be constructed initially with a cleat of the present invention or the cleat may be added to a worn or damaged lifter of the conventional type.

It is therefore an object of the present invention to provide for a rotary drum debarker lifter formed by providing a cleat on the vertex of a lifter to extend the lifetime of the lifter and to improve the lifting performance.

It is a further object of the present invention to provide for a method of repairing and reinforcing a rotary drum debarker lifter by welding a cleat onto the vertex of the lifter.

These and other objects and advantages of the present invention will be apparent from a consideration of the following detailed description of the preferred embodiments in conjunction with the appended drawings as described following.

DETAILED DESCRIPTION OF THE PREFERRED EMBODIMENTS

Figure 1:
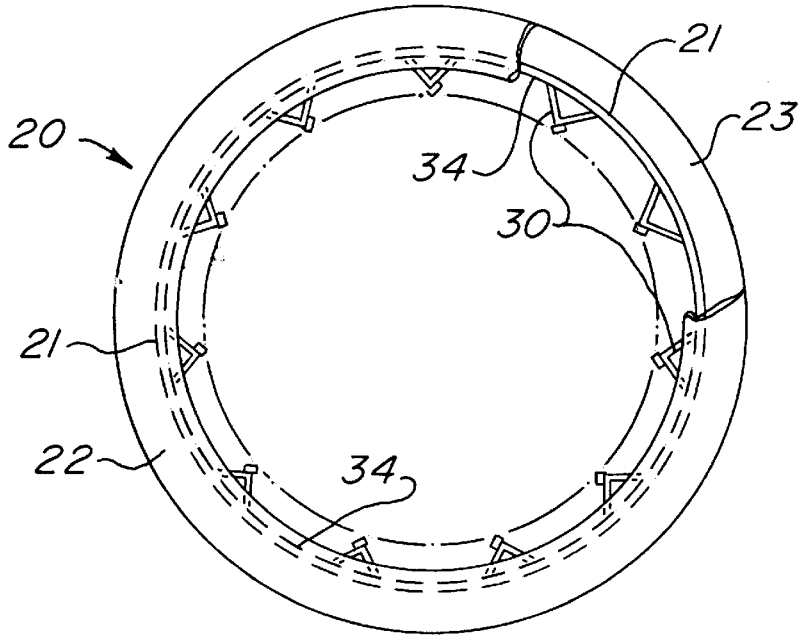
FIG. 1 is a partially sectioned inlet end elevation of a debarker drum with the modified lifters of the present invention.
Figure 2:
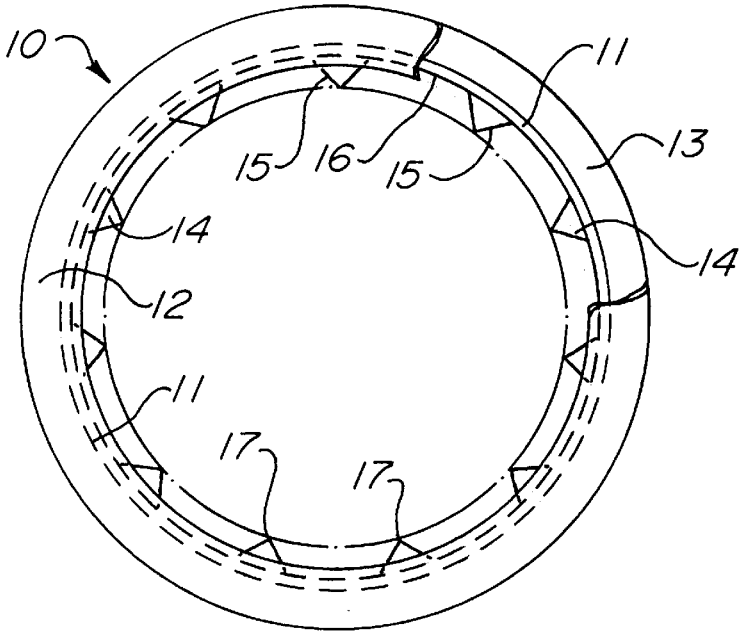
FIG. 2 PRIOR ART
FIG. 2 is a partially sectioned inlet end elevation of a prior art debarker drum.

With reference to FIGS. 1–4, the preferred embodiment of the present invention may be described. FIG. 2 is an elevational view of the inlet end of a debarker drum 10 of conventional type known in the prior art. A cylindrical shell 11 is reinforced with an inlet reinforcing ring 12 and an outlet reinforcing ring 13. The inlet reinforcing ring 12 is typically welded to the inlet end of the shell 11 and the outlet reinforcing ring 13 is welded to the outlet end of the shell 11. A plurality of conventional lifters 14 are in the form of angle irons with two legs 15 which are welded at their respective ends to the inside surface 16 of the shell 11. The conventional lifters 14 are oriented so that the vertex 17 is generally pointed toward the axis of rotation of the drum 10.

A debarker drum 20 having a plurality of modified lifters 30 of the present invention is shown in FIG. 1. The modified drum 20 comprises a cylindrical shell 21 having an inlet reinforcing ring 22 welded to the inlet end of the shell 21 and an outlet reinforcing ring 23 welded to the outlet end of the shell 21. The modified lifters 30 are welded to the inside surface 34 of the shell 21.

Figure 3:
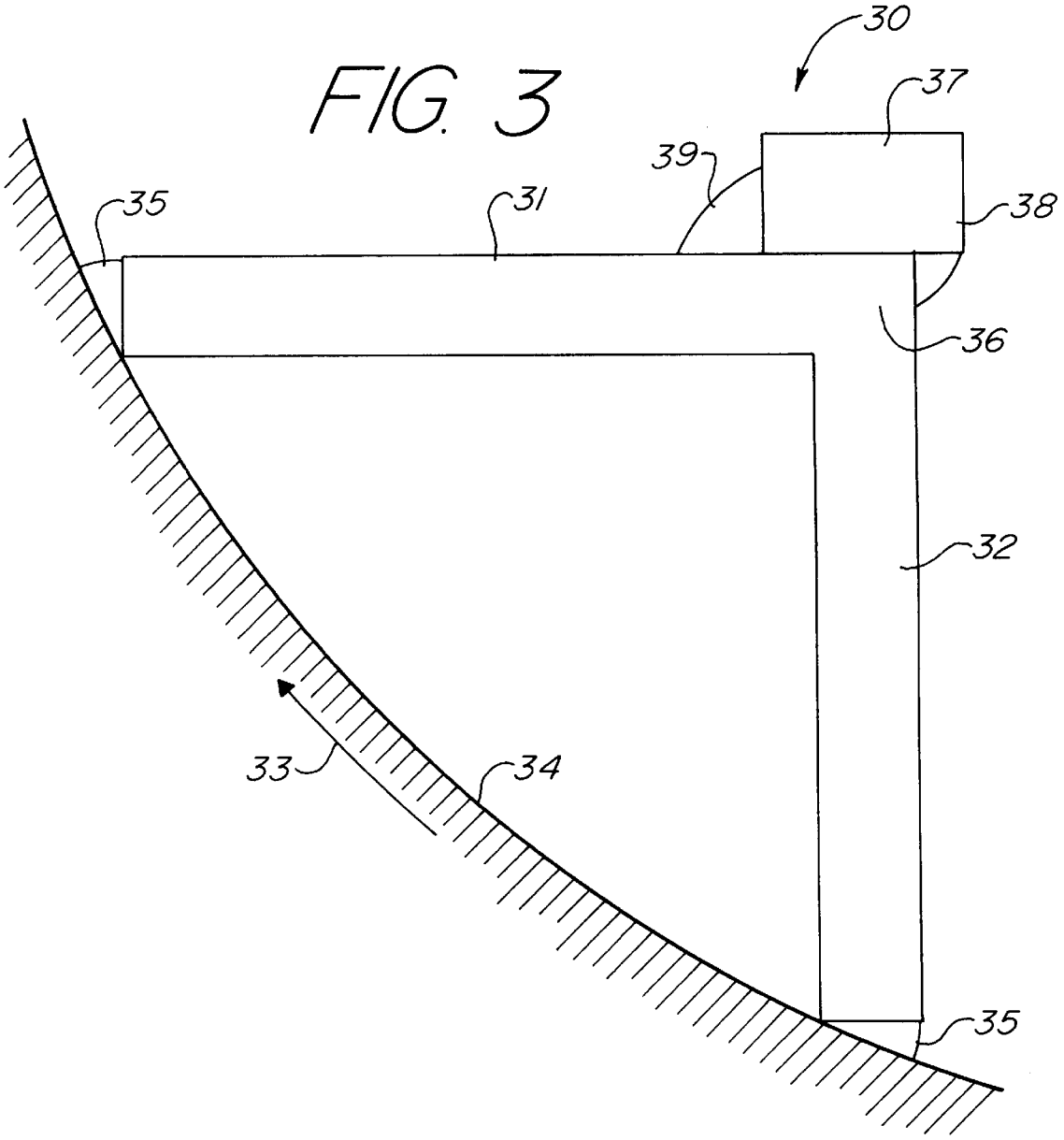
FIG. 3 is a partial section of a single lifter of the present invention shown in elevation from the inlet end of the debarker drum.
Figure 4:
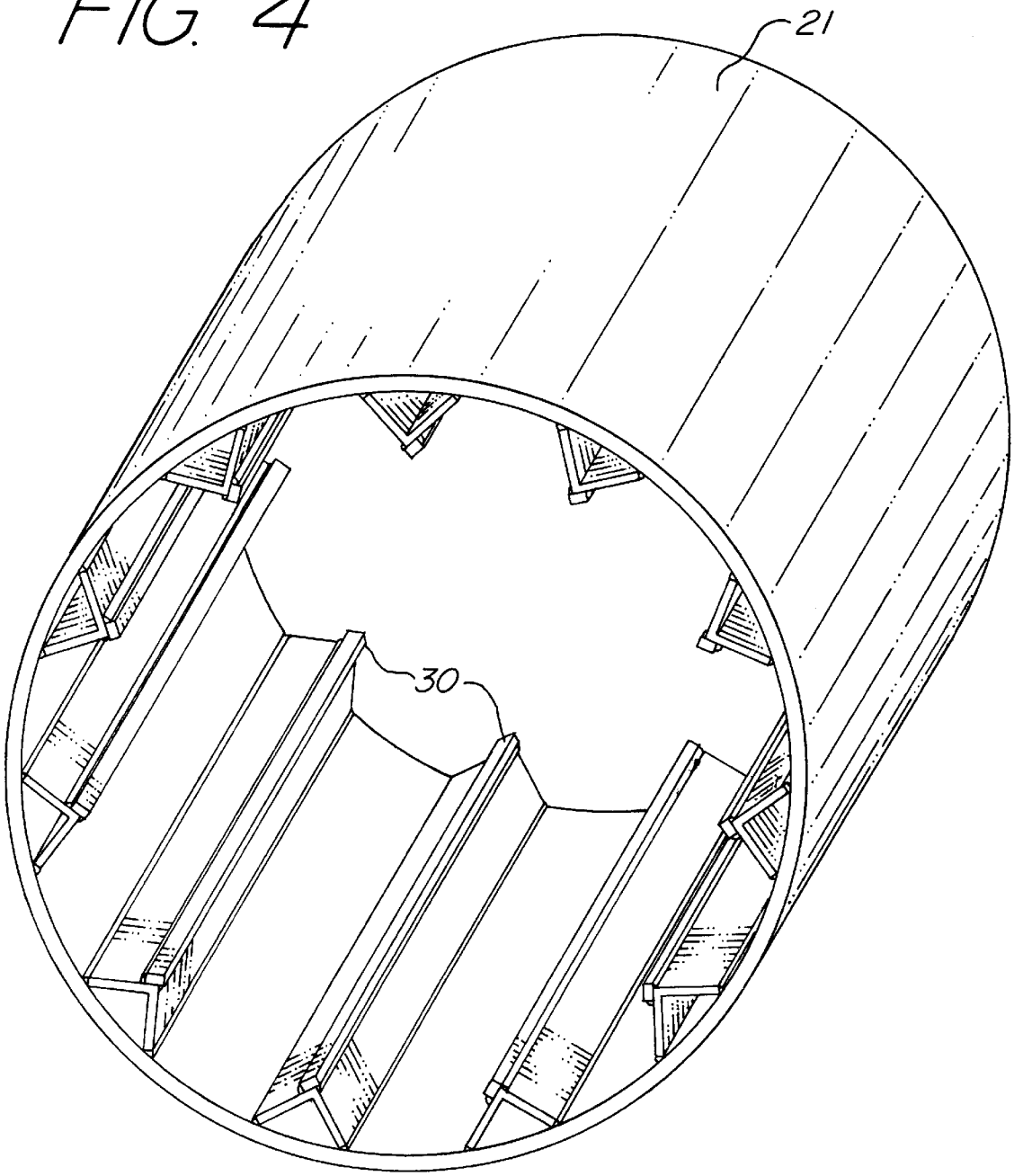
FIG. 4 is a perspective view of a debarker drum with the lifters of the present invention. The view is from the inlet end of the debarker drum.

FIG. 3 shows the modified lifter 30 of the present invention at an increased scale from FIG. 1. A single modified lifter 30 is shown. The modified lifter 30 has a forward leg 31 and a rearward leg 32. In this context, "forward" and "rearward" are understood to be with respect to the direction of rotation 33 of the drum 20. It should be understood that while the preferred embodiment of the present invention is described with reference to a lifter having a V-shaped cross section, the present invention is not so limited and may be employed with lifters having various cross sectional shapes, including L-shaped, U-shaped, and the like.

Each leg 31, 32 of the modified lifter 30 is attached to the inside surface 34 of the shell of the debarker drum 20 by welds 35. The vertex 36 is oriented toward the axis of rotation of the drum 20. It should be understood that the outer surfaces of the legs 31, 32, and in particular the forward leg 31, provide log engaging surfaces which act to enhance the lifting and tumbling action of the rotating debarker drum 20. The vertex 36 bears the brunt of the tumbling action of the logs. In the present invention, the vertex 36 is protected by a cleat 37 on the forward leg 31. The cleat 37 is desirably placed on the forward leg 31 in proximity to the vertex 36. Various shapes of the cleat 37 may be employed in the present invention. In a preferred embodiment, the cleat 37 is a rectangular bar sized to completely shield the vertex 36 from the tumbling action of the logs. Further, it is desirable that the cleat 37 be placed on the vertex 36 such that the cleat 37 overhangs the rearward leg 32. This overhanging portion 38 acts to further shield the vertex 36 and may serve as a sacrifical member which will wear in preference to wear to the rearward leg 32 and the vertex 36. In typical applications the cleat 36 may desirably be a hardened steel bar having a dimension along the forward leg 31 of around one and one half inch and a dimension along the rearward leg 32 of around one inch. The size of the cleat 37 can be increased or decreased to control the agressiveness of the lifting action. The cleat 37 is desirably attached to the lifter 30 by a forward weld 39 from the forward leg 31 to the cleat 37 and by a rearward weld 40 from the cleat to the rearward leg 32. Desirably the forward weld is around ¾ inch in radius and the rearward weld is around ⅜ inch in radius. Different welds and different methods of attachment known in the art are contemplated as being within the scope of the present invention. As may be seen from FIG. 4, a plurality of modified lifters 30 are affixed to the inside surface 34 of the shell 21 of the debarker drum. The lifters 30 are generally arrayed at regular radial intervals and are generally oriented longitudinally with respect to the axis of rotation of the drum. Different orientations of lifters and different sizes and shapes of debarker drums are known in the art and suchlike variations are contemplated within the scope of the present invention.

The placement of the cleat 37 shields the vertex 36 of the lifter 30 from excessive wear. The cleat 37 also provides enhanced lifting of the logs. It may readily be seen that the typical lifter of whatever shape may tend to allow the logs to slip off the lifter after rotation of the drum through a sufficient degree of rotational motion. For example, when the forward leg 31 of the lifter 30 approaches a vertical orientation, the force of gravity alone will likely cause the log to slip from the lifter 30. However, the addition of the cleat 37 provides additional friction between the log and the lifter allowing the log to be lifted higher in the drum and thereby to enhance the tumbling action of the debarker.

It may readily be seen that wear to the cleat 37 may occur from the tumbling action of the logs. A worn cleat 37 or a worn portion of a cleat 37 may be easily replaced as necessary. Furthermore, a debarker drum may be intially constructed with the modified lifters 30 of the present invention or conventional lifters 14 may be modified by the addition of a cleat 37 as taught by the present invention. This method of modification of a conventional lifter may be employed to repair a worn or damaged lifter and to extend the life and efficiency of a conventional lifter.

The present invention has been described with reference to certain preferred and alternative embodiments that are intended to be exemplary only and not limiting to the full scope of the present invention as set forth in the appended claims.

What is claimed is:

1. An improved lifter for a rotary drum debarker for removing the bark from logs, the rotary drum debarker having a shell mounted for rotation about an axis of rotation and further having a plurality of lifters arrayed on the interior of the shell and each lifter having a vertex oriented generally toward the axis of rotation of the shell, comprising:

a lifter, and a cleat affixed to the lifter, said cleat facing generally in the direction of rotation of the rotary drum debarker and said cleat placed so as to protect the vertex of the lifter from damage from rotating logs.

2. The improved lifter of claim 1 wherein said lifter comprises an angle iron having a forward leg and a rearward leg and said cleat comprises a generally rectangular bar affixed to said forward leg.

3. An improved rotary drum debarker for removing the bark from logs, comprising:

a shell mounted for rotation about an axis of rotation;

a plurality of lifters arrayed on the interior of the shell;

each of said lifters having a vertex oriented generally toward the axis of rotation of the shell; and a cleat affixed to each of said lifters, each of said cleats facing generally in the direction of rotation of the rotary drum debarker and each of said cleats placed so as to protect the vertex of the lifter from damage from rotating logs.

4. The improved rotary drum debarker of claim 3 wherein each of said lifters comprises an angle iron having a forward leg and a rearward leg and said cleat comprises a generally rectangular bar affixed to said forward leg.

5. A method of repairing a damaged lifter for a rotary drum debarker, wherein the rotary drum debarker is of the type having a shell mounted for rotation about an axis of rotation and further having a plurality of lifters arrayed on the interior of the shell and each lifter having a vertex oriented generally toward the axis of rotation of the shell, comprising the steps of:

affixing a cleat to the damaged lifter, said cleat facing generally in the direction of rotation of the rotary drum debarker and said cleat placed so as to protect the vertex of the lifter from further damage from rotating logs.

6. The method of claim 5 wherein wherein said lifter comprises an angle iron having a forward leg and a rearward leg and said cleat comprises a generally rectangular bar affixed to said forward leg.

* * * * *